US005847735A

United States Patent [19]

Betschon

[11] Patent Number: 5,847,735

[45] Date of Patent: Dec. 8, 1998

[54] INK CARTRIDGE FOR A PRINTER

[75] Inventor: Luzius Betschon, Uster, Switzerland

[73] Assignee: Pelikan Produktions AG, Zurich, Switzerland

[21] Appl. No.: 639,336

[22] Filed: Apr. 26, 1996

[51] Int. Cl.[6] ..... B41J 2/175

[52] U.S. Cl. ..... 347/86

[58] Field of Search ..... 347/85, 86, 87

[56] References Cited

U.S. PATENT DOCUMENTS 4,658,273 4/1987 Yuki et al. ..... 347/86
5,600,358 2/1997 Baldwin et al. ..... 347/87

FOREIGN PATENT DOCUMENTS 424133 4/1991 European Pat. Off. ..... 347/87

*Primary Examiner*—N. Le
*Attorney, Agent, or Firm*—Fay, Sharpe, Beall, Fagan, Minnich & McKee

[57] ABSTRACT

An ink cartridge for a printer comprises a casing having a cover with an opening for admitting air into the interior of the casing. An outer face of the cover has a meander-shaped capillary groove which extends from the opening to an S-shaped capillary channel. The outer face of the cover is covered by a foil seal which overlaps one of the transverse edges of the cover. Two cuts through the foil extend from opposed longitudinal edges into areas between two of the transverse branches of the channel.

6 Claims, 1 Drawing Sheet

INK CARTRIDGE FOR A PRINTER

BACKGROUND OF THE INVENTION

The subject invention is directed toward the art of ink jet printers and, more particularly, to an improved ink storage cartridge for such printers.

Cartridges for a print head of an ink jet printer which contain a porous ink storage body have an opening in a cover for admitting air. For reducing evaporation losses, it has been proposed to provide the inner surface of the cover with a long capillary groove. One end of the groove ends in a fill opening, and the other end communicates with a vent hole through the cover. The groove is covered by a foil. On the outside surface of the cover, a label is sealed over the fill opening. For shipment, the vent hole is sealed by an adhesive tape.

SUMMARY OF THE INVENTION

The object of the present invention is to simplify the manufacturing of a cartridge of the type described.

According to the present invention, the cartridge comprises a casing having a cover with a vent opening for admitting air into the interior of the casing. The outer face of the cover has a capillary groove with a first portion of the groove having a first end communicating with the opening and a second end communicating with an S-shaped second portion of the groove. The second portion includes three transverse branches and two connecting branches. The second portion ends at a location spaced from an edge of the cover. The outer face of the cover is covered by a sealed-on foil which overlaps one edge of the cover adjacent the second portion of the groove. Two cuts in the foil extend from opposed edges of the foil into areas between each of the transverse branches.

For shipment, the vent opening is completely sealed. Before or after insertion of the cartridge into the print head, the area of the foil with the overlapping edge is torn off. The foil then tears through from the end of the first cut towards the second cut and is peeled off. The S-shaped portion now communicates with the atmosphere.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT

Figure 1:
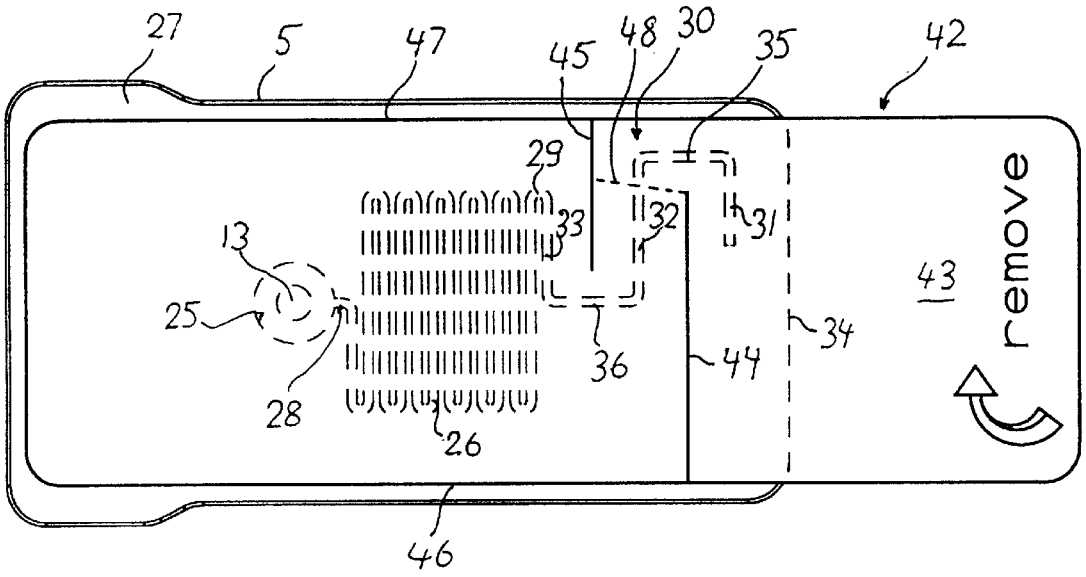
FIG. 1 shows a top view on the cover of the cartridge according to the invention; and, FIG. 2 is a partial cross section through the cartridge.
Figure 2:
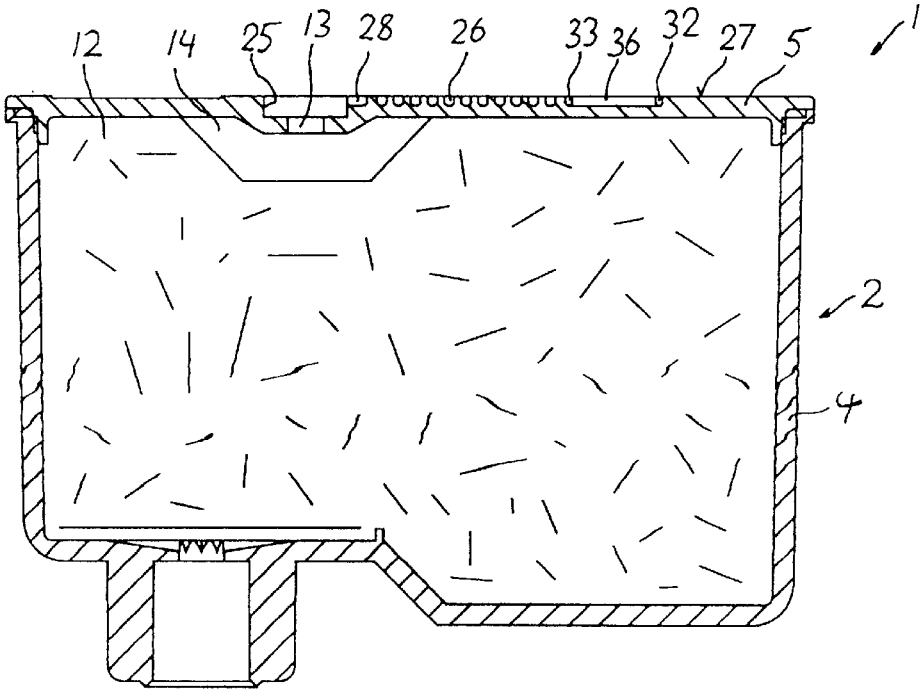

Referring now to the drawings wherein the showings are for the purposes of illustrating the preferred embodiment of the invention only and not for purposes of limiting same, the cartridge 1 of the preferred embodiment shown in FIGS. 1 and 2 comprises a casing 2 with lateral walls 4 on the free ends of which a cover 5 is sealed, such as by being welded thereto. The cartridge contains a porous body 12, e.g., of foamed synthetic material such as polyethylene. The cover has a recessed opening 13 for filling the body 12 with ink before shipment and for admitting air to a recessed space 14 of the body 12 during use of the cartridge in a print head of an ink jet printer. The recess 25 of the opening 13 is used to center and seal a filling tube for supplying the ink.

A narrow capillary is formed in the outer face 27 of the cover 5. The capillary groove has a first portion 26 with a first end 28 that extends into the recess 25 and is thereby connected to the opening 13. The other end 29 is connected to a second portion that comprises an S-shaped narrow capillary channel 30 with three transverse branches 31, 32, 33 parallel to the transverse edges 34 of the cover, and two connecting branches 35, 36 which are perpendicular to the transverse branches 31–34. The channel 30 ends at a Location spaced from the edge 34. Preferably, the first portion 26 of the capillary groove has a meandering or zig-zag form.

A foil 42 is sealed onto the outer face 27 of the cover 5. The foil 42 may be of aluminum coated with a thermoplastic for heat sealing or it may be a laminated or unlaminated thermoplastic foil. Alternatively, an adhesive tape may be used. The foil could also be coated with a hot melt adhesive. An end area 43 of the foil 42 overlaps the transverse edge 34 of the cover 5 adjacent the channel. Two transverse cuts 44, 45 are cut through the foil 42 starting from opposed longitudinal edges 46, 47 of the foil 42 and ending in the region between each two adjacent transverse branches 31, 32 and 32, 33. The area of the foil 42 to the left of the cut 45 in FIG. 1 is printed as a label for the cartridge. The area to the right of the cut 45 is torn off before use of the cartridge 1 in a printer. To this end, the foil 42 is grabbed at the overlapping area 43 and peeled off the cover 5 until the cut 44 is reached. Then the foil 42 is torn through starting from the inner end of cut 44. Since the cuts 44, 45 overlap by a substantial amount in their longitudinal direction, the tear line 48 which may be at an arbitrary angle to the longitudinal edges (indicated with dotted lines in FIG. 1) will automatically end at the cut 45. Thus, the branch 32 of the channel 30 is open to the atmosphere. The remaining foil 42 to the right of cuts 44, 45 remains as a label on the cover 5 and as an outside seal for the capillary groove and part of the channel 30. In case the user tears the area 43 sideways, the tear line 48 crosses one of the branches 35 or 31.

The same opening 13 is used for ink filling during production and for air admittance during use. A single foil is used as a label, as a seal for the fill opening, as a cover for the capillary groove, and as a hermetic seal for shipment. Therefore, an economic manufacturing of the cartridge is achieved. Because of the two overlapping cuts 44, 45, the foil 42 can be torn off in the length direction of the cover 5. Therefore, no overlap over the longitudinal edge 46 is required to the left of cut 44. This enables an inexpensive production of the labels from a continuous band.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An ink cartridge for a printer comprising:

a casing for containing ink;

a cover on said casing, said cover having an outer face and a peripheral edge with an opening through said outer face for admitting air into the interior of the casing, the outer face having a capillary groove including a first portion with a first end communicating with the opening and a second end communicating with a second portion having an S-shape with three transverse branches and two connecting branches, the second portion ending spaced from the peripheral edge of the cover; and, a foil seal on the outer face of the cover to overlie the capillary groove, the foil seal overlapping a portion of the peripheral edge of the cover adjacent the second portion of the capillary groove, two cuts through the foil seal extending from opposed edges of the foil into areas between two of the transverse branches.

2. The cartridge of claim 1 wherein the three transverse branches of the S-shaped portion of the capillary groove are substantially parallel to one another and to said two cuts through the foil.

3. The cartridge of claim 1 wherein the first portion of the capillary groove is meander shaped.

4. The cartridge of claim 1 wherein the foil is aluminum coated with a thermoplastic.

5. The cartridge of claim 1 wherein the foil is a thermoplastic foil.

6. The cartridge of claim 1 wherein the foil is rectangular in plan view and overlaps a portion of the peripheral edge of the cover that extends generally in the direction of the three transverse branches of the second portion of the capillary groove.

* * * * *